US005961317A

United States Patent [19]

Fauci

[11] Patent Number: 5,961,317

[45] Date of Patent: Oct. 5, 1999

[54] COMBUSTION HEAD ASSEMBLY

[76] Inventor: Joseph Fauci, 351 Cameo Dr., Massapequa, N.Y. 11758

[21] Appl. No.: 09/081,433

[22] Filed: May 19, 1998

[51] Int. Cl.[6] ..... F23C 5/60

[52] U.S. Cl. ..... 431/174; 431/60; 431/189; 431/154; 431/285; 126/350 R

[58] Field of Search ..... 431/60, 174, 281, 431/285, 278, 274, 154, 155, 178, 189, 179; 126/39 E, 350 R, 351, 374, 116 A

[56] References Cited

U.S. PATENT DOCUMENTS

| | | | |
|---|---|---|---|
| 1,751,533 | 3/1930 | Taylor | 126/350 R |
| 1,751,722 | 3/1930 | Bitgood | 431/179 |
| 2,018,179 | 10/1935 | Kuhner | 431/179 |
| 2,129,059 | 9/1938 | Herbster et al. | 126/116 A |
| 2,439,609 | 4/1948 | Mittendorf | 431/60 |
| 4,614,491 | 9/1986 | Welden | 431/285 |
| 4,952,136 | 8/1990 | Collins, Jr. et al. | 431/154 |
| 5,417,564 | 5/1995 | Briggs | 431/179 |

*Primary Examiner*—James C. Yeung
*Attorney, Agent, or Firm*—Collard & Roe, P.C.

[57] ABSTRACT

A combustion head assembly comprising a mounting plate having a plurality of apertures and adapted for mounting to a boiler, and a plurality of combustion heads removably mounted in each of the apertures. The combustion heads each have a fuel nozzle and ignition tips. There is at least one fuel source removably connected to the fuel nozzles of each of the combustion heads and at least one ignition source removably connected to the ignition tips of each of the combustion heads. There is at least one source of forced air removably connected to said combustion heads, and a controller adapted to operate each combustion head independently of the other combustion heads. Each combustion head can be removed from the assembly for repair and inspection without interrupting the operation of the other combustion heads and the boiler.

12 Claims, 3 Drawing Sheets

COMBUSTION HEAD ASSEMBLY

BACKGROUND OF THE INVENTION

1. Field of the Invention

This invention relates to a combustion head assembly for use with a boiler for generating heat for homes and businesses. In particular, the invention relates to a combustion head assembly comprising multiple combustion heads that can be easily removed and replaced.

2. The Prior Art

A traditional home heating or hot water unit consists of a burner connected to a boiler. The burner consists of a fan, a fuel source and a large combustion head having a fuel nozzle and ignition tips for igniting the fuel spray, all permanently connected in a single unit. This burner is permanently mounted through a large hole in a mounting plate on the boiler.

Based upon the desired temperature and the amount of heat desired to be generated, the burner fires according to a controller on the unit. The heat generated is based on the amount of time the burner is firing and the fuel is pumped into the boiler. The amount of fuel pumped into the boiler during firing is always a constant.

This standard method of generating heat in the boiler is extremely inefficient, since the same amount of fuel is fed into the boiler every time the controller fires the burner. There is no way to control the amount of fuel fired into the boiler so that an excess amount is not used. If a large amount of heat is required, a very large burner must be used. This can become very cumbersome and expensive.

Furthermore, the single unit construction of the burner makes it extremely inefficient and expensive to repair any broken components of the combustion head assembly. If any component of the assembly breaks, the entire boiler must be shut down and the assembly disassembled for repair. For this reason, many large institutional areas such as schools and office buildings have more than one boiler for use as a backup in the event of malfunctioning.

An easily removable burner has been proposed in U.S. Pat. No. 2,119,952 to Engels. Engels discloses an oil combustion head that is easily removable from its outer shell for repair and inspection. However, the shell is permanently mounted to the boiler. Furthermore, this burner also suffers from the drawback that the amount of heat, or BTU's generated during firing of the combustion head cannot be controlled.

SUMMARY OF THE INVENTION

It is therefore an object of the present invention to provide a combustion head assembly that is small, efficient and simple to install.

It is another object of the present invention to provide a combustion head assembly in which combustion head parts can be repaired and inspected without interrupting the operation of the heating system.

It is yet another object of the present invention to provide a combustion head assembly that can be retrofit onto existing boilers.

It is a further object of the present invention to provide a combustion head assembly that can be used for oil, gas, or a combination of oil and gas in the same boiler.

These and other objects of the invention are accomplished by a combustion head assembly comprising a plurality of combustion heads and a mounting plate having a plurality of apertures therethrough. The mounting plate can be shaped for mounting in the combustion head hole of a conventional boiler plate, or the mounting plate can replace the boiler plate. Each of the apertures is sized to accommodate a combustion head.

Each combustion head is comprised of a casing holding a fuel nozzle connected to a fuel source, ignition tips connected to an ignition source, and a connection to a supply of forced air, such as from a fan. In smaller installations, there is a single fuel source, ignition source and fan connected to all of the combustion heads. In larger installations, two or more fuel sources, ignition sources and fans may be used. A controller is connected to each of the combustion heads to control their rate of firing. The controller is programmed to fire only the minimum number of combustion heads to achieve the required amount of heat. This way, the system according to the invention is much more efficient than a boiler having a single large combustion head.

The system according to the invention also has the advantage that any one or more of the combustion heads can be easily disconnected and removed from the assembly for repair and inspection without interrupting the operation of the boiler or the other combustion heads. The remaining connected combustion heads continue to fire and produce heat for the boiler while the removed combustion heads are being worked on. This feature is also very cost efficient, because the necessity of providing and maintaining multiple boilers in case of malfunctions is eliminated.

Additionally, two different fuel sources could be used in the same boiler, in several different ways. For example, some of the combustion heads could be connected to a gas line while others are connected to an oil pump. Alternatively, all of the combustion heads could be connected to both fuel sources and fire both gas and oil simultaneously.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
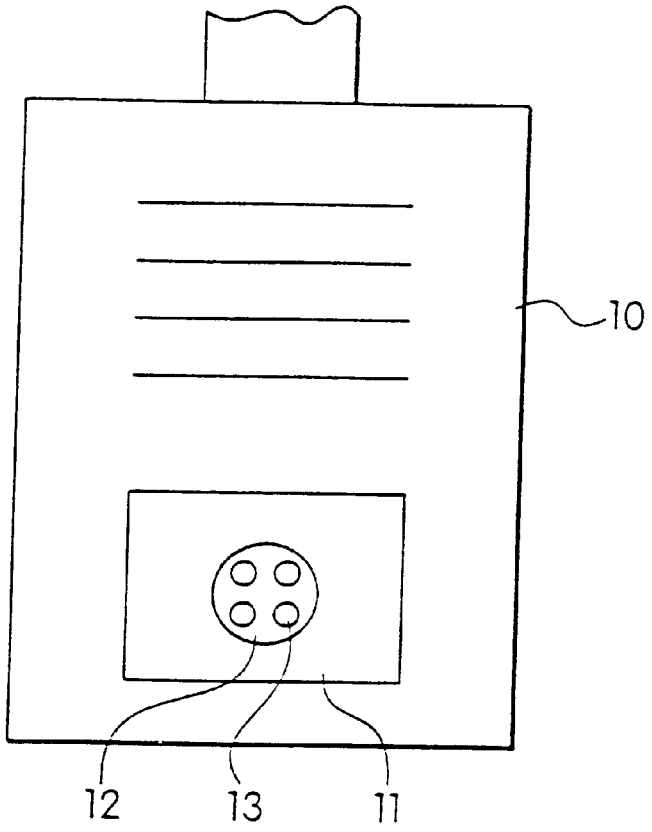
FIG. 1 shows a front view of a boiler having a cover plate for the combustion head assembly according to the invention.

Referring now in detail to the drawings and, in particular, FIG. 1, there is shown a boiler 10 having a standard boiler plate 11, in which a standard oil combustion head can be mounted. According to the invention, a mounting plate 12 is mounted within the standard combustion head hole on boiler plate 11. Mounting plate 12 has a plurality of apertures 13, for fitting combustion heads in the combustion head assembly according to the invention. Mounting plate 12 can be fitted to any existing boiler plate, to replace the traditional large single combustion head that fits into the hole in the boiler plate. Mounting plate 12 accommodates four smaller combustion heads, but could also be made to accommodate a larger or smaller number of combustion heads as well.

Figure 2:
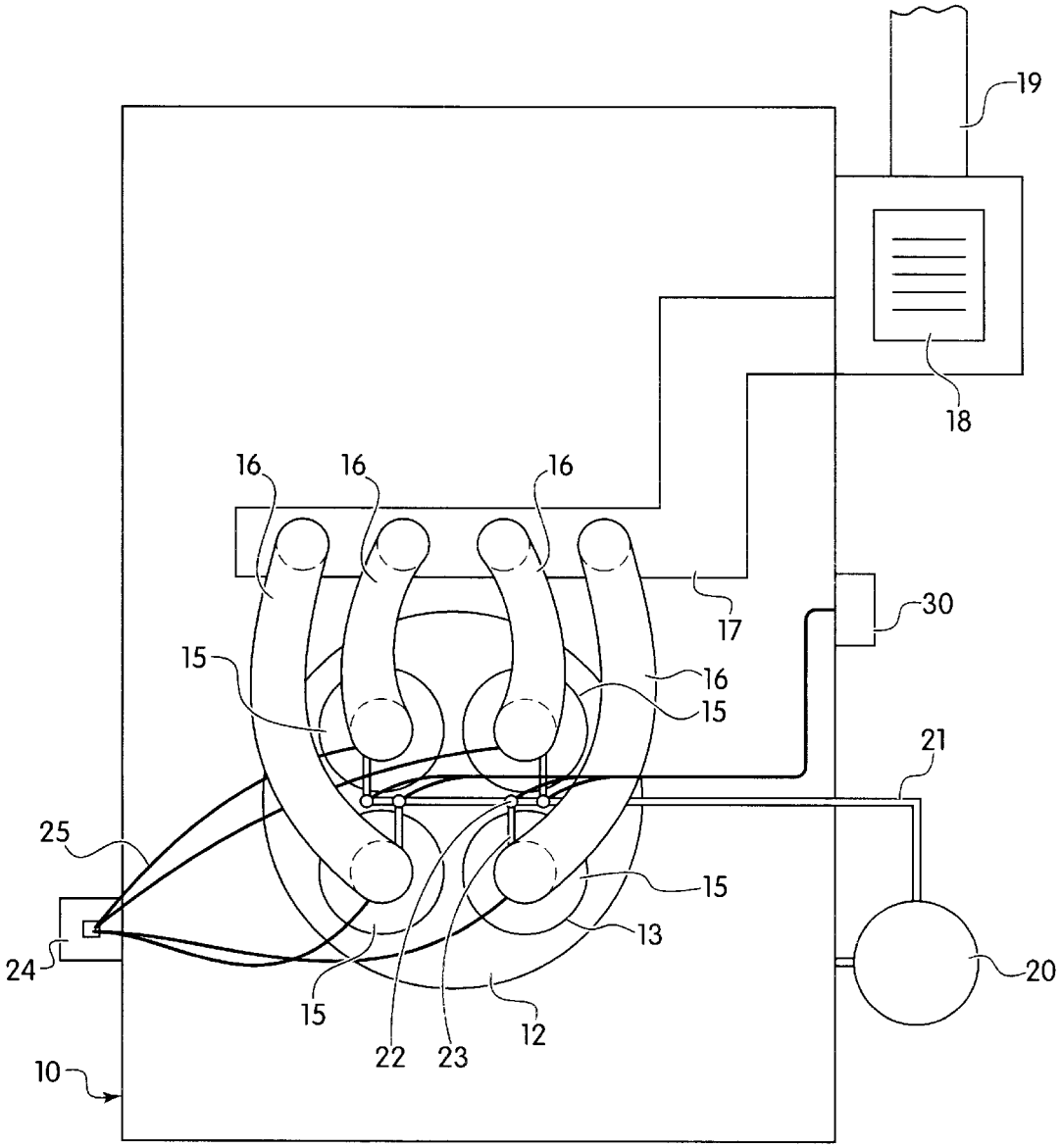
FIG. 2 shows a schematic view of the combustion head assembly according to the invention connected to a boiler.

FIG. 2 shows a front schematic view of the boiler having the full combustion head assembly mounted thereto. A plurality of combustion heads 15 are mounted in apertures 13 in mounting plate 12. A fan 18 is connected to each of combustion heads 15 through a conduit 17 connected to flexible hoses 16, which feed air from fan 18 into combustion heads 15. The air fed to combustion heads 15 comes from outside intake 19, which feeds fresh air to fan 18.

A remote mounted fuel source 20, feeds fuel to each of combustion heads 15 through a conduit 21. Fuel source 20 could be an oil tank connected to a pump, or a gas line. Conduit 21 has a plurality of valves 22 that allow the fuel to be shut off for each combustion head. A fuel line 23 runs from each valve into each combustion head 15. Valves 22 allow a combustion head to be removed from the assembly without disrupting the operation of the other combustion heads. A plug may be inserted into the hole in the mounting plate when the combustion head is removed.

An ignition source 24 is connected to each combustion head 15 through wires 25. Ignition source 24 can be of any suitable type commonly used in heating systems. A controller 30 is connected to each of fuel valves 22 to control the flow of fuel into each combustion head. Depending upon the amount of heat desired, controller 30 opens or closes a predetermined number of valves so that only the minimum number of combustion heads required to generate the specified amount of heat are fired. The specified amount of heat is determined by a thermostat (not shown) connected to the controller. Controller 30 can be any conventionally used heating controller.

Figure 3:
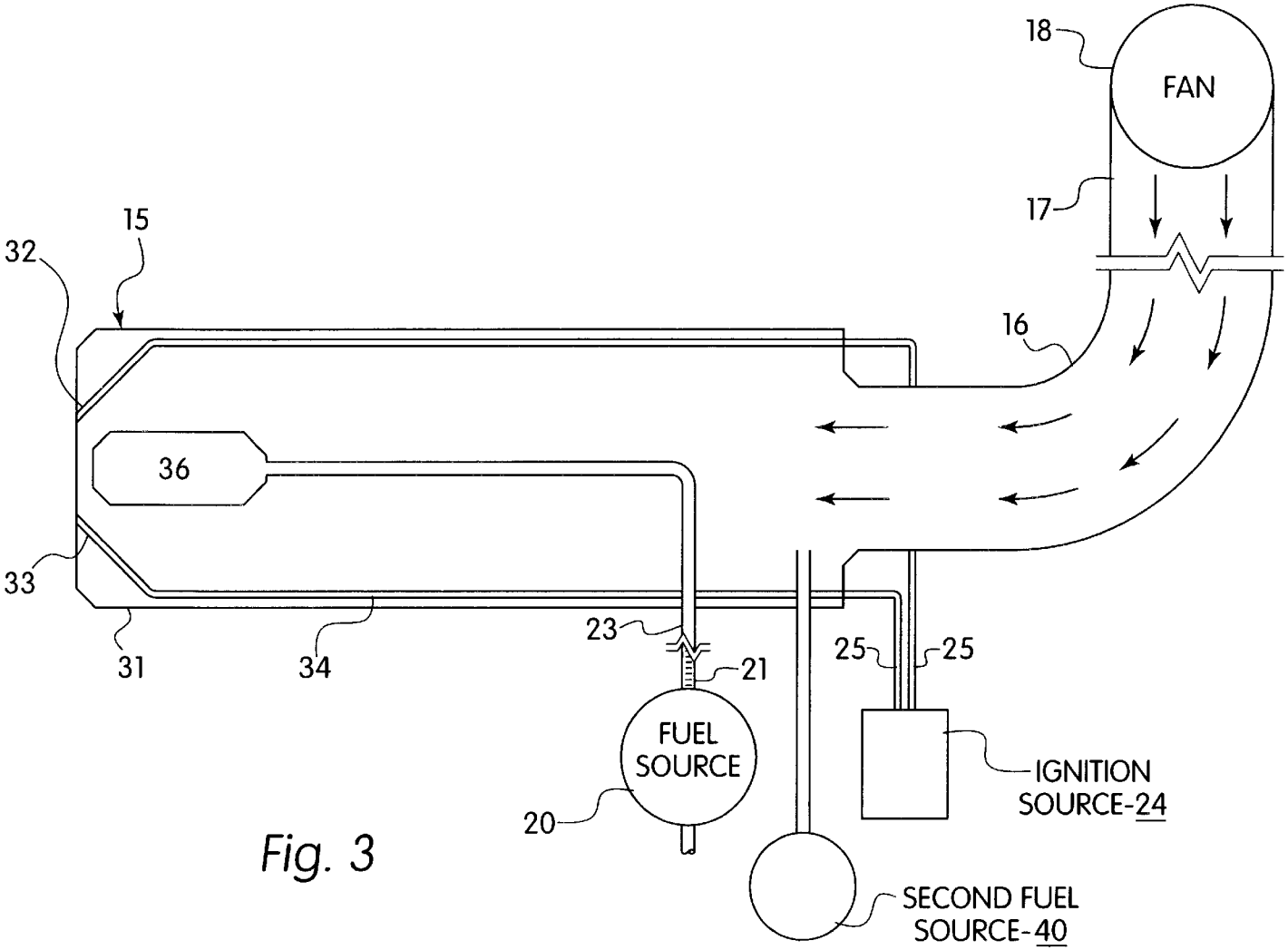
FIG. 3 shows a schematic view of one of the combustion heads in the assembly according to the invention.

FIG. 3 shows a side schematic view of a single combustion head 15 connected to fuel source 20, fan 18 and ignition source 24. Combustion head 15 has a casing 31 containing a fuel nozzle 36 connected to fuel line 23, which as shown in FIG. 2 is connected to fuel source 20 which in this case is oil. Wires 25 from ignition source 24 run through combustion head 15 to ignition tips 32 and 33. A spark from tips 32 and 33 ignites fuel sprayed from nozzle 36 to create heat for the boiler, as with any conventional combustion head system. Alternatively, combustion head 15 could be connected to a second fuels source 40, such as a gas line which operates without nozzle 36, and can fire this second fuel source 40 either instead of or in addition to fuel source 20, which is fed through nozzle 36. This way, combustion head 15 could simultaneously burn both oil and gas, which could lead to a more efficient use of fuel if there are two fuel sources such as oil and gas, each combustion head can be connected to both fuel sources and adapted to fire both fuels simultaneously.

The present combustion head assembly is an improvement over the prior art because each combustion head can be easily removed without disrupting the operation of any of the other combustion heads. This results in a huge cost savings, especially with large heating systems because it eliminates the need for a backup boiler. Since boiler shutdowns are often the result of a damaged combustion head, the present invention keeps the boiler running even if one or more combustion heads is inoperative.

Figure 4:
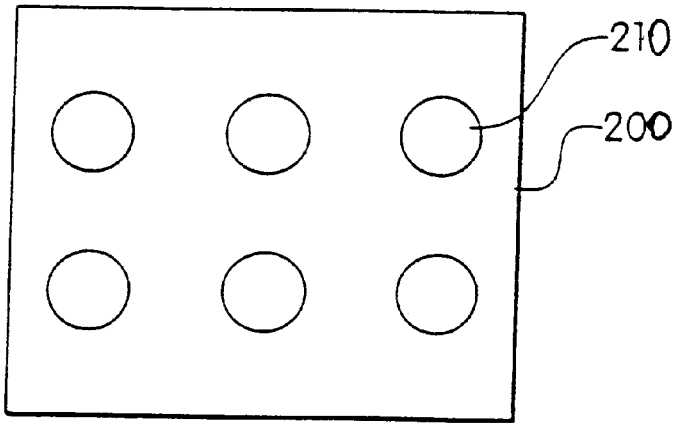
FIG. 4 shows an alternative embodiment of the mounting plate for the assembly according to the invention attached to a boiler.

FIG. 4 shows an alternative mounting plate 200 for use with the combustion head assembly according to the invention. In this embodiment, mounting plate 40 replaces the traditional boiler plate shown as 11 in FIG. 1. This allows many more combustion heads to be mounted in holes 210 to boiler 10, because of the increased space allowed. Plate 40 is intended for use with new boiler constructions, and not as a retrofit design for an existing boiler, as is the case with the embodiment of FIGS. 1 and 2.

Accordingly, while only a few embodiments of the present invention have been shown and described, it is obvious that many changes and modifications may be made thereunto without departing from the spirit and scope of the invention.

What is claimed is:

1. A combustion head assembly comprising:

a mounting plate having a plurality of apertures and adapted for mounting to a boiler having an interior portion, said apertures communicating with the interior of the boiler when said mounting plate is mounted thereon wherein the mounting plate is adapted for mounting into the combustion head opening of a standard boiler plate;

a plurality of combustion heads, each combustion head having a fuel nozzle and ignition tips and being removably mounted in the apertures of the mounting plate;

at least one fuel source removably connected to the fuel nozzles of each of said combustion heads;

at least one ignition source removably connected to the ignition tips each of said combustion heads;

at least one source of forced air removably connected to said combustion heads; and a controller adapted to operate each combustion head independently of the other combustion heads;

wherein each combustion head can be removed from the assembly for repair and inspection without interrupting the operation of the other combustion heads and the boiler.

2. The combustion head assembly according to claim 1, wherein the controller comprises a control device to fire the minimum number of combustion heads to provide a predetermined amount of heat.

3. The combustion head assembly according to claim 2, further comprising a valve connected to each combustion head and to the controller, wherein the controller opens and closes the valves depending on the number of combustion heads to be fired.

4. A combustion head assembly comprising:

a mounting plate having a plurality of apertures and adapted for mounting to a boiler having an interior portion, said apertures communicating with the interior of the boiler when said mounting plate is mounted thereon wherein the mounting plate is a boiler plate for mounting directly to the boiler;

a plurality of combustion heads, each combustion head having a fuel nozzle and ignition tips and being removably mounted in the apertures of the mounting plate;

at least one fuel source removably connected to the fuel nozzles of each of said combustion heads;

at least one ignition source removably connected to the ignition tips each of said combustion heads;

at least one source of forced air removably connected to said combustion heads; and a controller adapted to operate each combustion head independently of the other combustion heads;

wherein each combustion head can be removed from the assembly for repair and inspection without interrupting the operation of the other combustion heads and the boiler.

5. The combustion head assembly according to claim 4, wherein the controller comprises a control device to fire the minimum number of combustion heads to provide a predetermined amount of heat.

6. The combustion head assembly according to claim 5, further comprising a valve connected to each combustion head and to the controller, wherein the controller opens and closes the valves depending on the number of combustion heads to be fired.

7. A combustion head assembly comprising:

a mounting plate having a plurality of apertures and adapted for mounting to a boiler having an interior portion, said apertures communicating with the interior of the boiler when said mounting plate is mounted thereon;

a plurality of combustion heads, each combustion head having a fuel nozzle and ignition tips and being removably mounted in the apertures of the mounting plate;

at least two fuel sources removably connected to the fuel nozzles of each of said combustion heads, wherein one fuel source is oil and the other fuel source is gas, and wherein there is at least one combustion head connected to the gas fuel source, and at least one combustion head connected to the oil fuel source;

at least one ignition source removably connected to the ignition tips each of said combustion heads;

at least one source of forced air removably connected to said combustion heads; and a controller adapted to operate each combustion head independently of the other combustion heads;

wherein each combustion head can be removed from the assembly for repair and inspection without interrupting the operation of the other combustion heads and the boiler.

8. The combustion head assembly according to claim 7, wherein the controller comprises a control device to fire the minimum number of combustion heads to provide a predetermined amount of heat.

9. The combustion head assembly according to claim 8, further comprising a valve connected to each combustion head and to the controller, wherein the controller opens and closes the valves depending on the number of combustion heads to be fired.

10. A combustion head assembly comprising:

a mounting plate having a plurality of apertures and adapted for mounting to a boiler having an interior portion, said apertures communicating with the interior of the boiler when said mounting plate is mounted thereon;

a plurality of combustion heads, each combustion head having a fuel nozzle and ignition tips and being removably mounted in the apertures of the mounting plate;

at least two fuel sources removably connected to the fuel nozzles of each of said combustion heads, wherein one fuel source is oil and the other fuel source is gas, and wherein there is at least one combustion head connected to the gas fuel source, and wherein each combustion head is connected to both fuel sources and is adapted to fire both fuels simultaneously;

at least one ignition source removably connected to the ignition tips each of said combustion heads;

at least one source of forced air removably connected to said combustion heads; and a controller adapted to operate each combustion head independently of the other combustion heads;

wherein each combustion head can be removed from the assembly for repair and inspection without interrupting the operation of the other combustion heads and the boiler.

11. The combustion head assembly according to claim 10, wherein the controller comprises a control device o fire the minimum number of combustion heads to provide a predetermined amount of heat.

12. The combustion head assembly according to claim 11, further comprising a valve connected to each combustion head and to the controller, wherein the controller opens and closes the valves depending on the number of combustion heads to be fired.

* * * * *